US011110023B1

(12) United States Patent
Knight et al.

(10) Patent No.: US 11,110,023 B1
(45) Date of Patent: Sep. 7, 2021

(54) CHAIR WITH SWIVEL AND BRAKE SYSTEM

(71) Applicant: Boyd Industries, Inc., Clearwater, FL (US)

(72) Inventors: Jesse Knight, Clearwater, FL (US); Tim Sass, Clearwater, FL (US); Tim Maneval, Clearwater, FL (US)

(73) Assignee: Boyd Industries, Inc., Clearwater, FL (US)

( * ) Notice: Subject to any disclaimer, the term of this patent is extended or adjusted under 35 U.S.C. 154(b) by 0 days.

(21) Appl. No.: 16/838,722

(22) Filed: Apr. 2, 2020

Related U.S. Application Data

(60) Provisional application No. 62/828,144, filed on Apr. 2, 2019.

(51) Int. Cl.

| | |
|---|---|
| ***A61G 15/02*** | (2006.01) |
| ***A47C 1/032*** | (2006.01) |
| ***A47C 3/18*** | (2006.01) |
| ***A47C 3/24*** | (2006.01) |
| ***A47C 7/50*** | (2006.01) |
| ***A47C 1/024*** | (2006.01) |
| ***A61G 15/00*** | (2006.01) |

(52) U.S. Cl.
CPC ..... *A61G 15/02* (2013.01); *A47C 1/0242* (2013.01); *A47C 1/03211* (2013.01); *A47C 3/18* (2013.01); *A47C 3/24* (2013.01); *A47C 7/50* (2013.01); *A61G 15/00* (2013.01)

(58) Field of Classification Search
CPC ..... A61G 15/02; A61G 15/10; A61G 15/00; A47C 7/50; A47C 3/24; A47C 1/0242; A47C 1/03211; A47C 3/18
USPC .... 297/330, 344.12, 344.21, 344.22, 344.23, 297/344.2, 344.26
See application file for complete search history.

(56) References Cited

U.S. PATENT DOCUMENTS

| | | | | | |
|---|---|---|---|---|---|
| 2,648,579 | A * | 8/1953 | Slyter | A47C 3/18 | 384/615 |
| 2,886,096 | A * | 5/1959 | Eckart | A61G 15/02 | 297/80 |
| 3,804,460 | A * | 4/1974 | Leffler | A61G 15/02 | 297/330 |
| 3,834,660 | A * | 9/1974 | Leffler | A61G 15/10 | 248/418 |
| 6,938,957 | B2 * | 9/2005 | Beatty | B64D 11/064 | 297/344.22 |
| 2004/0195886 | A1 * | 10/2004 | Beatty | B60N 2/14 | 297/344.22 |
| 2010/0102611 | A1 * | 4/2010 | Bunea | B64D 11/064 | 297/344.23 |

FOREIGN PATENT DOCUMENTS

| | | | | |
|---|---|---|---|---|
| CA | 3029876 | A1 * | 1/2018 | A61B 3/0025 |
| DE | 2118614 | A1 * | 11/1971 | A61G 15/02 |
| DE | 102005052487 | A1 * | 7/2007 | A61G 15/12 |
| EP | 0838207 | A2 * | 4/1998 | G01D 5/165 |
| GB | 1473284 | A * | 5/1977 | B60N 2/02 |

* cited by examiner

*Primary Examiner* — Robert Canfield
(74) *Attorney, Agent, or Firm* — J. Coy Stull; William G. Giltinan; Carlton Fields, PA

(57) ABSTRACT

A chair including a seat, a seatback, a lift, at least one electric motor, and a brake and swivel system having a dual bearing Lazy Susan rotating mechanism, two soft bumpers, and a disc brake locking mechanism with a handle.

15 Claims, 5 Drawing Sheets

CHAIR WITH SWIVEL AND BRAKE SYSTEM

CROSS-REFERENCE TO RELATED APPLICATIONS

This application claims priority to Provisional application No. 62/828,144, filed Apr. 2, 2019, which is incorporated by reference herein in its entirety.

FIELD OF INVENTION

The present invention relates to a chair, and more particularly to a chair for use during treatment that is capable of rotation using a brake and swivel system and adjusting the seat height in the vertical direction and adjusting the pitch of the seatback.

BACKGROUND

Past chairs for use in examination have demonstrated a variety of seating arrangements. The typical device is capable of adjusting the pitch of the seatback and in some circumstances the height of the chair. These past adjustable chairs typically use hydraulic systems for moving the seatback and/or height of the chair. Hydraulic systems are known to have the undesirable features of loud movement, large footprint, unreliability, and difficult installation. They also are prone to leaking and have higher failure rates.

Past chairs have failed to provide a chair with decreased height from the seat of the chair to the ground. These chairs are difficult for patients to get in and out of. Further, they are particularly difficult for patients with disabilities to access.

Past chairs are also known to have complex control systems for adjusting the height of the chair and pitch of the seatback. Further, many chairs have unwieldy systems for rotating the chair. These systems provide difficulties for practitioners trying to make adjustments to the chair, particularly during examinations.

Past chairs have also provided seatbacks that are contoured for the comfort of the patient, but add accessibility issues for the practitioner during examination. The difficulties arise because the edge of the contour on the peripheral edge of the seatback protrudes too far in relationship to the contoured interior of the seatback.

Past chairs also do not provide a set of desirable features that provide a chair with hands-free rotation, chair height adjustment, and seatback pitch adjustment.

A need exists to overcome the problems discussed above.

SUMMARY

The disclosure describes embodiments of a chair that overcomes the disadvantages of past known chairs. In accordance with this disclosure, a chair is provided comprising a seat, brake and swivel system, a lift capable of extending and retracting as the height of the chair is adjusted, a seatback, at least one electric motor for use in adjusting the height of the chair, and at least one electric motor for use in adjusting the pitch of the seatback. In certain embodiments, the seat is coupled to the brake and swivel system and the lift is coupled to the brake and swivel system. In certain embodiments, the electric motor(s) for use in adjusting the height are housed inside the lift.

In accordance with a further feature of embodiments according to this invention, the chair includes seatback-mounted hand controls for adjusting the chair height (vertically) and the pitch of the seatback.

In accordance with yet another feature of embodiments according to this invention, the seatback-mounted hand controls include at least one programmable position control button and a home button.

In accordance with yet another feature of embodiments according to this invention, the seatback-mounted hand controls are minimal and symbols on the hand controls are raised to help assist in location by touch. In certain embodiments, the hand controls, other than the symbols on the hand controls, are flush with the seatback. In certain embodiments the symbols on the hand controls are also flush with the seatback (i.e., not raised).

In accordance with another feature of embodiments according to this invention, the chair includes a foot control assembly for adjusting the chair height vertically and the pitch of the seatback.

In accordance with yet another feature of embodiments according to the invention, the foot control assembly includes programmable position controls for chair height and pitch of the seatback.

In accordance with yet another feature of embodiments according to this invention, the foot control assembly includes only three programmable position controls.

In accordance with another feature of embodiments according to this invention, the electric motor or motors that are used in adjusting the height of the chair are electric screw drive motors. In certain embodiments, the electric screw drive motors are housed inside the lift. In certain embodiments, at least four electric screw drive motors are housed inside the lift.

In accordance with another feature of embodiments according to this invention, the chair height can be adjusted to a lower height of about 21.25 inches from the ground to the underside of the seat and an upper height of about 27.25 inches from the ground to the underside of the seat.

In accordance with another feature of embodiments according to this invention, the chair includes a brake and swivel system that includes a dual bearing Lazy Susan rotating mechanism, a disc brake locking mechanism, and two soft bumpers for rotational stops.

In accordance with yet another feature of embodiments according to this invention, the brake and swivel system includes a handle that provides easy lock and release of the disc brake locking mechanism. In certain embodiments, the easy lock and release can be used by a user without the use of hands.

In accordance with another feature of embodiments according to this invention, the chair includes a contoured seatback.

Although the examples illustrated and described herein are embodied in a novel chair, the invention is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

Other features that are considered as characteristic for the invention are set forth in the claims. Detailed embodiments of the present invention are disclosed herein; however, it is to be understood that the disclosed embodiments are merely exemplary of the invention, which can be embodied in various forms. Specific structural and functional details disclosed herein are not to be interpreted as limiting, but merely as a basis for the claims and as a representative basis for teaching one of ordinary skill in the art to variously employ the present invention in an appropriately detailed structure. Further, the terms and phrases used herein are not intended to be limiting; but rather, to provide an understandable description of the invention. While the specification concludes with claims defining the features of the invention, it is believed that the invention will be better understood from a consideration of the following description in conjunction with the figures. The figures are not drawn to scale.

BRIEF DESCRIPTION OF THE DRAWINGS

The accompanying figures serve to further illustrate various embodiments and explain various principles and advantages in accordance with the present invention.

DETAILED DESCRIPTION

The present invention provides a novel, efficient, and ergonomic chair comprising a seat, a brake and swivel system, a seatback, a lift capable of extending and retracting as the height of the chair is adjusted, and at least one electric motor capable of adjusting the height of the chair. Embodiments provide further details of the subject chair. Such features provide for a more reliable, comfortable and functional chair, and allow a practitioner to adjust the position of the chair throughout examination in a comfortable and efficient manner. In certain embodiments, adjustments to the position of the chair may be made without using hands, thereby avoiding the need to replace surgical gloves mid-procedure in some cases. Embodiments of the invention also have the benefit of compactness.

Figure 1A:
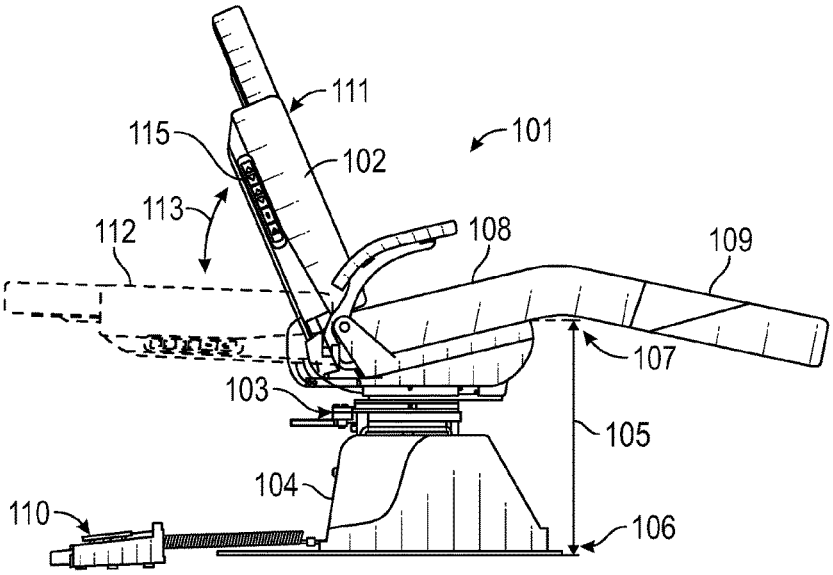
FIG. 1A is a side view of an exemplary chair in accordance with the present invention showing the seatback in a raised and lowered position.
Figure 1B:
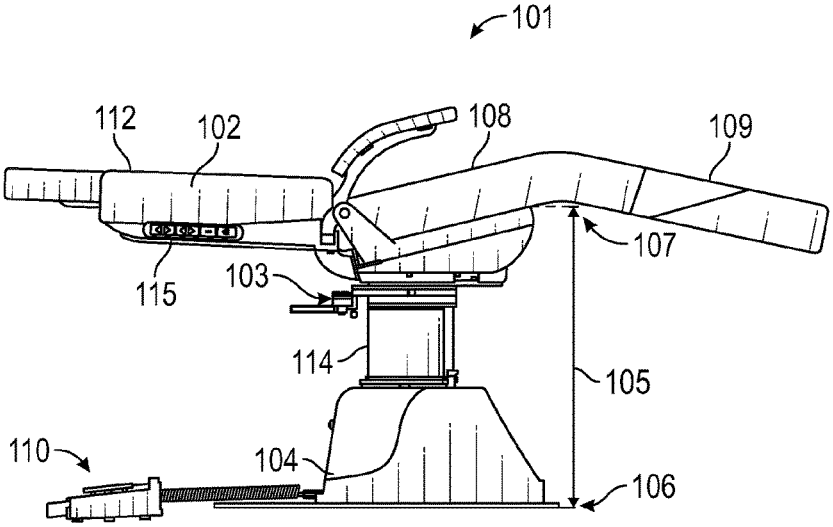
FIG. 1B is a side view of an exemplary chair in accordance with the present invention showing the seatback in a lowered position.

FIGS. 1A and 1B show embodiments of the chair system from a side view. FIGS. 1A and 1B display several beneficial features, for example, FIGS. 1A and 1B include a chair 101 supported by a base 104. The chair 101 is coupled to an inventive brake and swivel system 103 that is described in further detail in this application, including in FIG. 4. The chair 101 in FIG. 1A is shown in a lowered position where the height 105 of the chair 101 is in its lowest position. In certain preferred embodiments, the chair 101 can be lowered to a chair height 105 as low as about 21.25 inches from the ground 106 to the underside of the seat 107. This lowered start height of the chair allows for the benefits of easy ingress and egress of patients—which is especially helpful for handicap patient accessibility.

FIGS. 1A and 1B also detail the seat 108, leg rest 109, and foot control assembly 110 of the chair 101. FIG. 1A shows the seatback 102 of the chair 101 inclined in the raised position 111 and declined to a lowered position 112 (parallel to the ground) and the pitch 113 of the incline 111 and decline 112 of the seatback 102—this direction is commonly referred to as the pitch axis. FIG. 1B shows the chair 101 with the seatback 102 in the lowered position 112 that is parallel to the ground. In certain embodiments of the invention the foot control assembly 110 can include programmable position controls for adjusting the position of the chair 101 including the seatback 102 and chair height 105. In one preferred embodiment, the foot control assembly 110 includes three programmable position controls for positioning the chair height 105 and the pitch 113 of the seatback 102 of the chair 101.

The embodiment of the chair 101 shown in FIGS. 1A and 1B is adjustable vertically such that the chair height 105 can be raised and lowered by an electric motor or motors housed in the lift 114 (that extends and retracts with height adjustment) that is attached to the base 104 and coupled to the brake and swivel system 103. As shown in FIGS. 1A and 1B, the brake and swivel system 103 adjusts vertically along with the chair 101 as the lift 114 raises and lowers the chair 101. The lift 114 can be seen in FIG. 1B as the chair 101 is depicted at a chair height 105 that is higher than the lowest start chair height 105 (which is depicted in in FIG. 1A). In a preferred embodiment, the motor or motors are an electric screw drive motor, which provides a benefit to the patient of quiet, smooth, and comfortable movement. The use of an electric screw drive motor has a lower cost, smaller footprint, increased reliability, and easy installation as compared to hydraulics. In certain preferred embodiments, the chair 101 includes a plurality of electric screw drive motors for raising and lowering the height 105 of the chair 101—each of which is housed in the lift 114. In certain particularly preferred embodiments of the chair 101, four electric screw drive motors for raising and lowering the height 105 of the chair 101 are housed within the lift 114. In embodiments of the inventive chair, the number and size of electric motors that are used for raising the chair 101 can be varied depending on the desired size of the footprint of the chair 101 and size and weight of the load to be lifted.

FIGS. 1A and 1B also show seatback-mounted hand controls 115 for adjusting the chair height 105 vertically and the pitch direction 113 of the seatback 102. An embodiment of the seatback-mounted hand controls 115 is shown in more detail in FIG. 3. In certain embodiments, the seatback-mounted hand controls 115 are minimal, and symbols on the hand controls 115 are raised to help assist in location by touch. In certain embodiments, the minimal seatback-mounted hand controls 115 are flush with the seatback 102. In certain embodiments, the minimal hand controls 115 are flush with the seatback 102 with the exception of the raised symbols on the hand controls 115. In a certain preferred embodiment, one programmable preset position (i.e, chair height and seatback pitch) button is included in the seatback-mounted hand controls 115. In certain embodiments, the pitch direction 113 of the seatback 102 is adjusted by a motor. In certain preferred embodiments, the motor is an electric motor.

Figure 2:
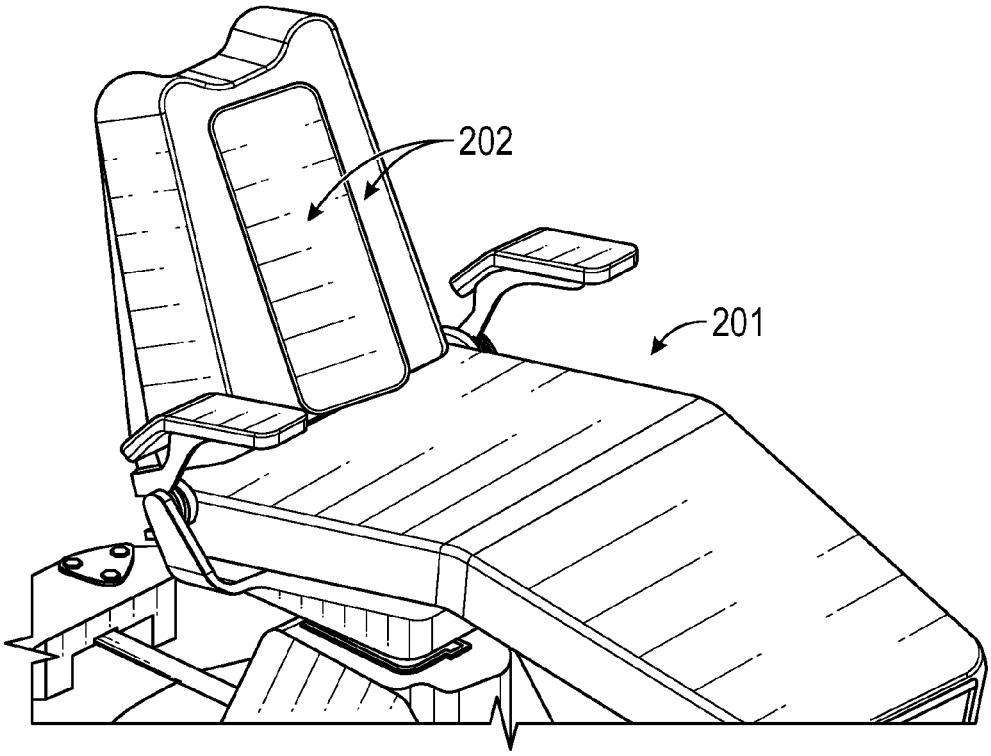
FIG. 2 is a perspective view of an exemplary chair in accordance with the present invention showing a contoured seatback.

FIG. 2 shows a perspective view of an embodiment of a chair 201 that includes a contoured seatback 202. In this particular embodiment, the contoured seatback 202 cradles the patient providing stability and comfort and also allows access for practitioners and assistants.

Figure 3:
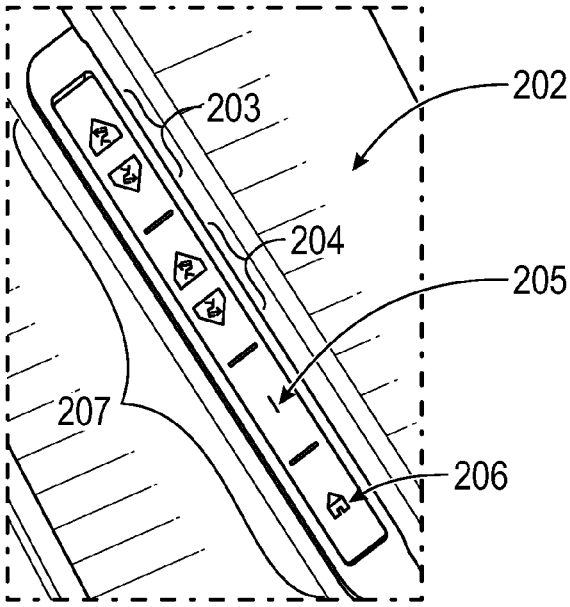
FIG. 3 is a detailed perspective view of seatback-mounted controls used in certain embodiments of the present invention

FIG. 3 shows a detailed perspective view of the seatback-mounted hand controls 207 for an embodiment of the inventive chair 201 (as depicted in FIG. 2). In this embodiment, the seatback-mounted hand controls 207 include buttons for, 203 adjusting the chair height, 204 adjusting the pitch of the seatback, 205 a programmable position control, and 206 a return to home position control—the home position being the beginning chair height and seatback pitch. In this embodiment, the seatback-mounted hand controls 207 are raised in order to assist in location of a particular button by touch. This ability to find buttons by touch relieves the user from having to look away from a task to make adjustments on the chair. FIG. 3 depicts a preferred embodiment of the seatback-mounted hand controls 207 that includes only one programmable position control 205. By having only one programmable position control 205 there is a benefit of reduced clutter, which makes it easier for the user to control the positioning of the chair 201 (as depicted in FIG. 2).

Figure 4:
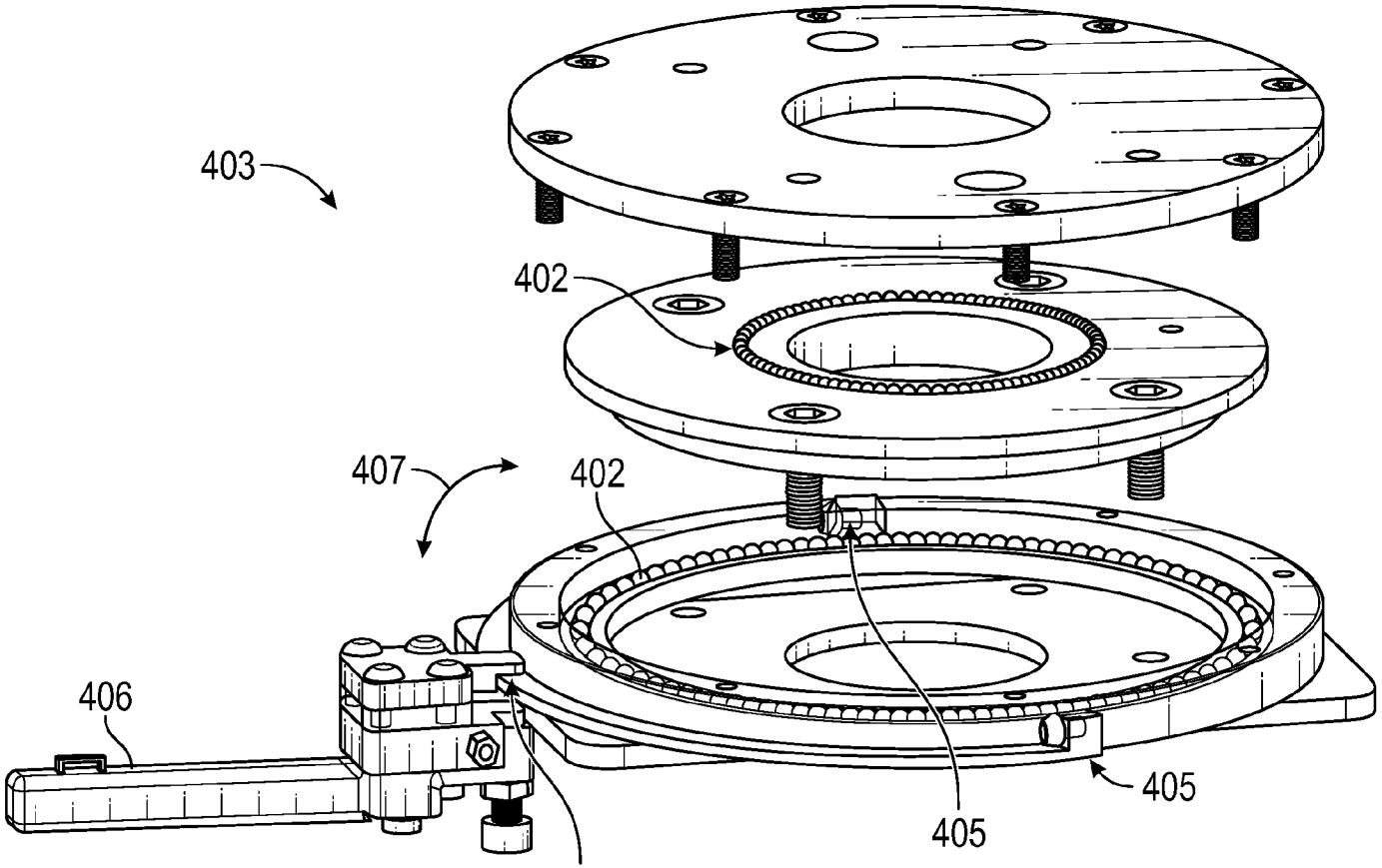
FIG. 4 is an exploded perspective view of a brake and swivel system used in certain embodiments of the present invention.

FIG. 4 shows an exploded perspective view of a brake and swivel system 403 that can be coupled to a chair and lift in embodiments of the invention, for example, the chair described in FIGS. 1A and 1B. The novel brake and swivel system 403 uses a dual bearing 402 Lazy Susan rotating mechanism 407 (which may conveniently be adapted for easy, finger-touch operation) with disc brake locking mechanism 404 and two soft bumpers 405 for rotational stops. The dual set of ball bearings 402 ensure alignment and finger touch movement. The handle 406 provides easy lock and release of the disc brake locking mechanism 404. In certain embodiments the handle 406 may be adapted to be operable by the knees of a medical practitioner seated on a stool while performing a procedure on a patient in an embodiment of the inventive chair, including but not limited to adjusting the height of the brake and swivel system 403 by lowering or raising the lift of the chair (e.g., as shown in FIGS. 1A and 1B). By positioning handle 406 at knee-height and providing it with sufficient length and configuration that it need not be gripped by a hand, a medical practitioner will have the option of locking and unlocking the disc brake locking mechanism 404 without having to remove his or her hands from the patient or replace gloves after adjustment. As a result, in certain embodiments of the invention a brake and swivel system 403 can positioned, designed and sized to be operable without the use of hands. Based on this disclosure, however, others of skill in the art will identify other embodiments of a brake and swivel system adapted for hands-free use, including (without limitation) designs involving the use of drum, disc, or simple friction brakes, a variety of handle designs and locking/unlocking orientations, and variations of the Lazy Susan structure, all of which are intended to be within the scope of this inventive disclosure.

Figure 5:
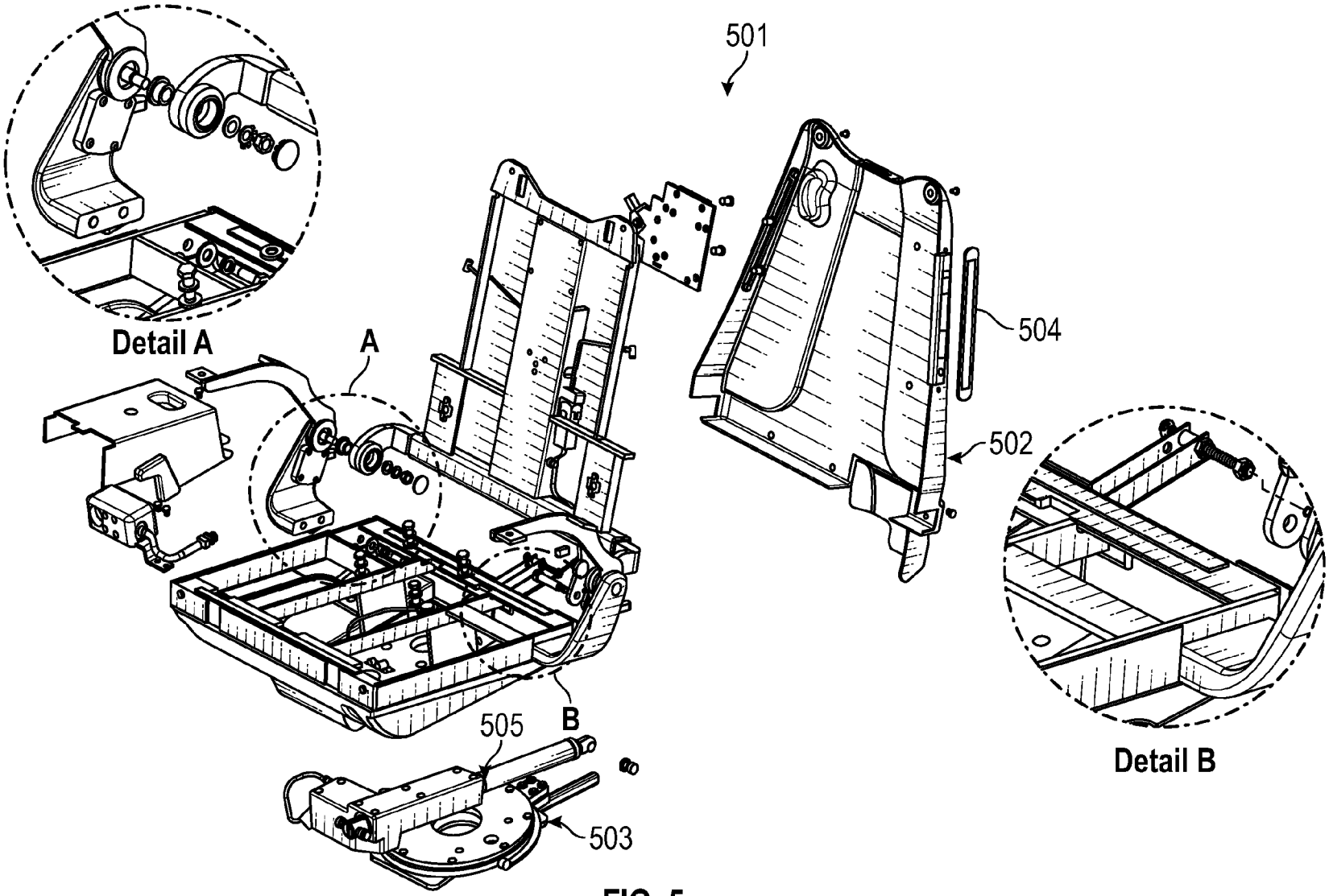
FIG. 5 is a perspective view of the components of the chair portion of an embodiment of the invention and their arrangement, including two exploded detail views (A-B).

FIG. 5 shows a detailed perspective view of an embodiment of a chair 501 (without a base portion) which includes a seatback 502 with seatback-mounted hand controls 504, brake and swivel system 503, and an electric motor 505 for adjusting the pitch direction of the seatback 502 (e.g., as depicted in FIGS. 1A and 1B). In this particular embodiment the electric motor 505 is an electric screw drive motor that is housed inside the seat when the chair is assembled. FIG. 5 further shows certain internal components of the chair 501 and their arrangement and two exploded detail views of certain internal components of the chair 501 (A-B).

Figure 6:
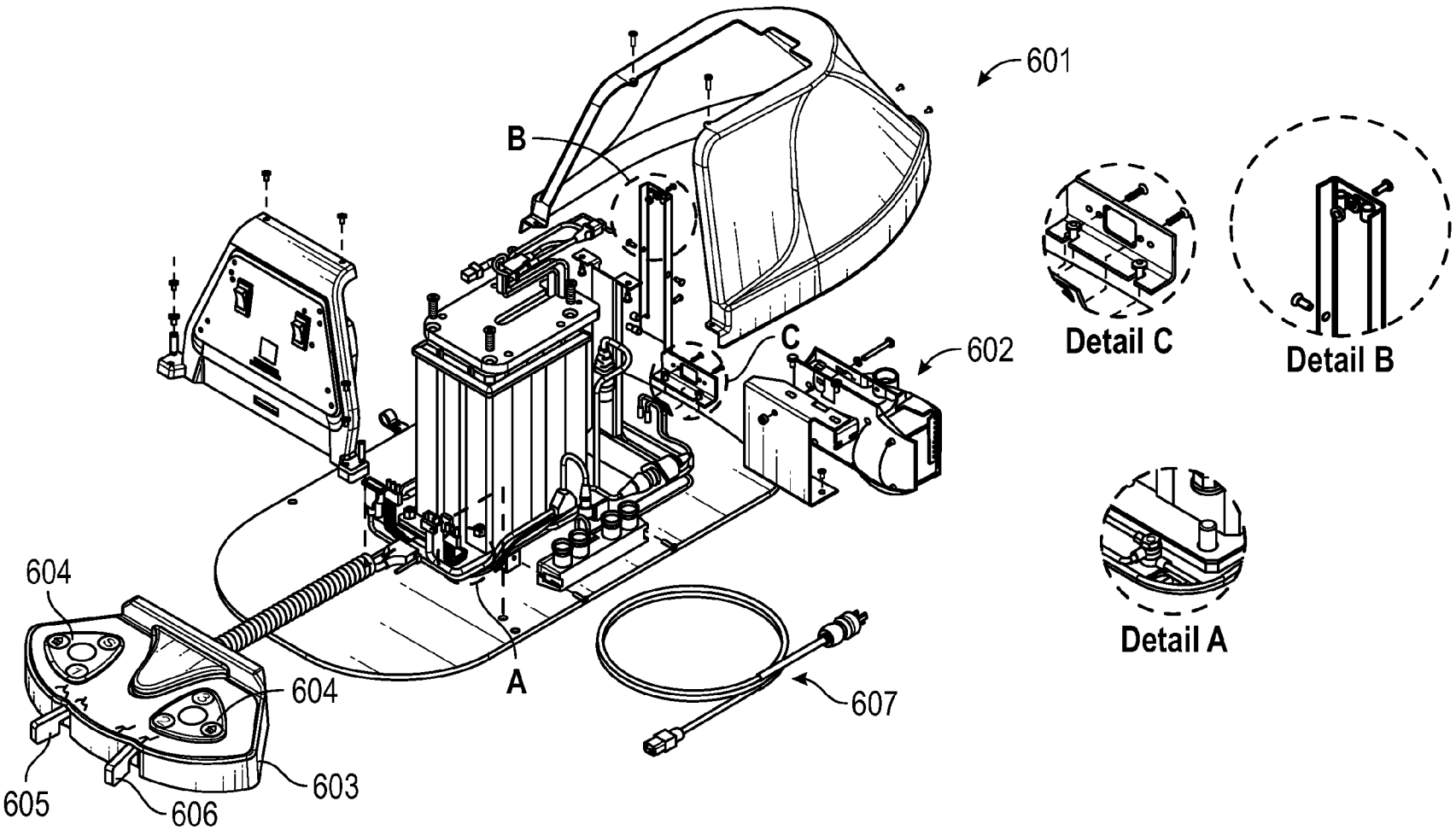
FIG. 6 is a perspective view of the components of the base portion of an embodiment of the present invention and their arrangement, including three exploded detail views (A-C).

FIG. 6 shows a detailed perspective view of a base 601 including a lift 602, and a foot control assembly 603 that can be used in embodiments of the invention. In certain embodiments, the combination of foot control assembly 603 with a knee-height positioned (or positionable) handle on a brake and swivel system (e.g., 403) enable the practitioner to make a wide range of seat adjustments without their hands, thereby allowing them to maintain focus on the procedure at hand and avoid the need for re-gloving after each adjustment. The foot control assembly 603 in this particular embodiment includes foot operable buttons 604, including three buttons for programmable preset positions (shown as "1", "2", and "3"), one home position button (shown as a picture of house), and one set button for setting programmable preset buttons (shown as "S"). These buttons 604 can be used to control the chair height and seatback pitch of the chair. In certain embodiments, the invention, the foot control assembly 603 may contain more or less foot operable buttons 604 than displayed in FIG. 6. The foot control assembly 603 also includes two foot operable pedals 605 and 606 for controlling the seatback pitch of the chair (605) and chair height (606). FIG. 6 further shows certain internal components of the base 601 and their arrangement and three exploded detail views of the base 601 (A-C).

The base 601 that can be used in embodiments of the invention includes four electric screw drive motors for use in raising and lowering the height of a chair (e.g, 101, 201, 501) housed inside the lift 602 which can extend or retract as the height of the chair is adjusted. In embodiments of the invention, a plurality of electric screw drive motors can be used to raise or lower the height of the chair.

The electric motors described in this disclosure may be powered by any known means in the art, including via AC or DC input—whether directly or indirectly, converted or unconverted. The base 601 which may be used in embodiments of the invention depicts an AC power input 607 which can be attached to the base 601 when an embodiment of the inventive chair is assembled.

The invention claimed is:

1. A chair comprising:
- a seat;
- a leg rest;
- a brake and swivel system;
- a lift;
- at least one electric screw drive motor housed within the lift,
  - wherein the electric screw drive motor can adjust the height of the chair,
  - further wherein the height of the chair can be adjusted to at least about 21.75 inches from the ground to the underside of the seat; and
- a seatback,
  - wherein the pitch of the seatback can be adjusted to a position parallel to the ground.

2. The chair of claim 1 wherein the swivel and brake system comprises a dual bearing Lazy Susan rotating mechanism, a disc brake locking mechanism, two soft bumpers for rotational stops, and a handle.

3. The chair of claim 1 wherein the chair comprises a plurality of electric screw drive motors housed with the lift, wherein the electric screw drive motors can adjust the height of the chair.

4. The chair of claim 1 wherein the seatback is contoured.

5. The chair of claim 1 wherein the seatback includes seatback-mounted hand controls for adjusting the chair height vertically and the pitch of the seatback.

6. The chair of claim 5 wherein seatback-mounted hand controls are flush with the seatback and symbols on the hand controls are raised.

7. The chair of claim 6 wherein the seatback-mounted hand controls include one programmable preset position button.

8. The chair of claim 1 further comprising a foot control assembly including foot operable pedals and at least one foot operable programmable position button for adjusting the position of the chair.

9. The chair of claim 8 wherein the foot control assembly includes three programmable position controls for positioning the chair height and the pitch of the seatback.

10. A chair comprising:

a seat;

a leg rest;

a brake and swivel system, wherein the brake and swivel system comprises:

a dual bearing Lazy Susan rotating mechanism;

a disc brake locking mechanism;

two soft bumpers for rotational stops; and a handle;

a lift;

at least one electric motor, wherein the at least one electric motor can adjust the height of the chair;

a seatback, wherein the pitch of the seatback can be adjusted to a position parallel to the ground; seatback-mounted hand controls for adjusting the height of the chair and the pitch of the seatback; and a foot control assembly including at least one foot operable programmable position button and foot operable pedals for adjusting the position of the chair including the seatback pitch and chair height.

11. The chair of claim 10 wherein the motor is an electric screw drive motor housed within the lift.

12. The chair of claim 10 wherein said brake and swivel system is capable of being positioned such that said handle is at knee-height in at least one chair height setting.

13. The chair of claim 10 wherein the height of the chair can be adjusted to at least about 21.75 inches from the ground to the underside of the seat.

14. A chair comprising:

a seat;

a leg rest;

a brake and swivel system, wherein the brake and swivel system comprises:

a rotating mechanism;

a locking mechanism consisting of a disc, drum, or friction brake; and a handle;

wherein said brake and swivel system is capable of being positioned such that said handle is at knee-height;

a lift;

a plurality of electric screw drive motors housed within the lift, wherein the electric screw drive motors can adjust the height of the chair, a seatback, wherein the pitch of the seatback can be adjusted;

seatback-mounted hand for controls adjusting the chair height and the pitch of the seatback; and a foot control assembly including at least one foot operable programmable position button and foot operable pedals for adjusting the position of the chair including the seatback pitch and chair height.

15. The chair of claim 14 comprising four electric motors housed within the lift.

* * * * *